US005146722A

United States Patent [19]

Stafford

[11] Patent Number: 5,146,722

[45] Date of Patent: Sep. 15, 1992

[54] FABRIC STRUCTURE WITH DOUBLE TENSIONING CABLES

[76] Inventor: Robert M. Stafford, 3017 Clay, Newport Beach, Calif. 92663

[21] Appl. No.: 561,017

[22] Filed: Jul. 31, 1990

[51] Int. Cl.[5] ..... E04B 1/32

[52] U.S. Cl. ..... 52/222; 52/63; 52/86; 135/102

[58] Field of Search ..... 52/63, 86, 222; 135/102, DIG. 1, DIG. 5, 119

[56] References Cited

U.S. PATENT DOCUMENTS

| | | | |
|---|---|---|---|
| 4,036,244 | 7/1977 | Huddle | 135/102 X |
| 4,593,710 | 6/1986 | Stafford | 52/86 X |
| 4,644,706 | 2/1987 | Stafford et al. | 52/86 X |

*Primary Examiner*—David A. Scherbel
*Assistant Examiner*—Kien Nguyen
*Attorney, Agent, or Firm*—Baker, Maxham, Jester & Meador

[57] ABSTRACT

A rapidly erectable building structure includes a plurality of arches each having a pair of lower ends. Base mechanisms are provided for holding the lower ends of the arches to position them in longitudinally spaced, transversely extending, vertical positions. A plurality of panels of a flexible web material are stretched between the arches. Each panel has a pair of opposite side edges, a width corresponding to a longitudinal distance between adjacent ones of the arches and a length corresponding to a transverse distance spanned by the arches. A first pair of lines is connected to a first end portion of each panel and a second pair of lines is connected to an opposite second end portion of the same panel. The lines extend generally arcuately between the side edges of the panel and are spaced a predetermined distance apart in the transverse direction. The base mechanisms guide the terminal segments of each line so that they can be pulled together to thereby transversely tension the panels between the arches.

7 Claims, 1 Drawing Sheet

FIG. 1
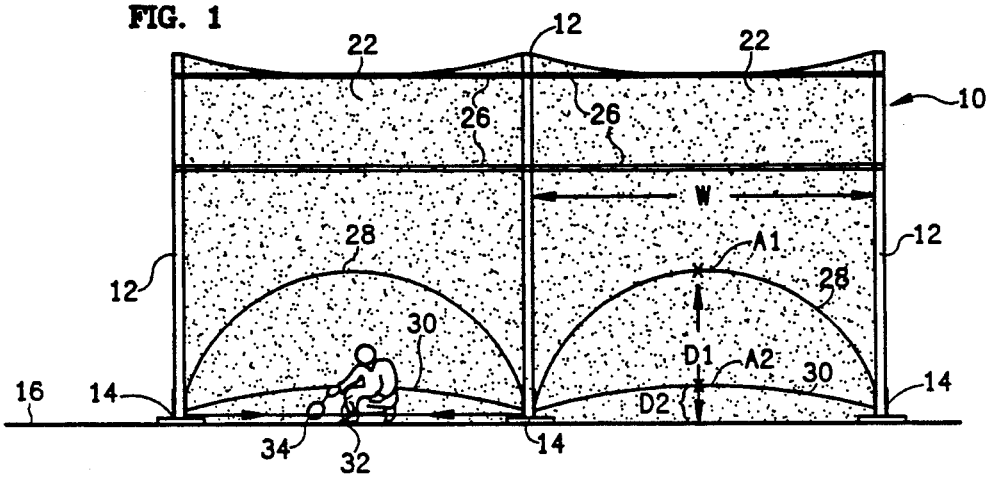
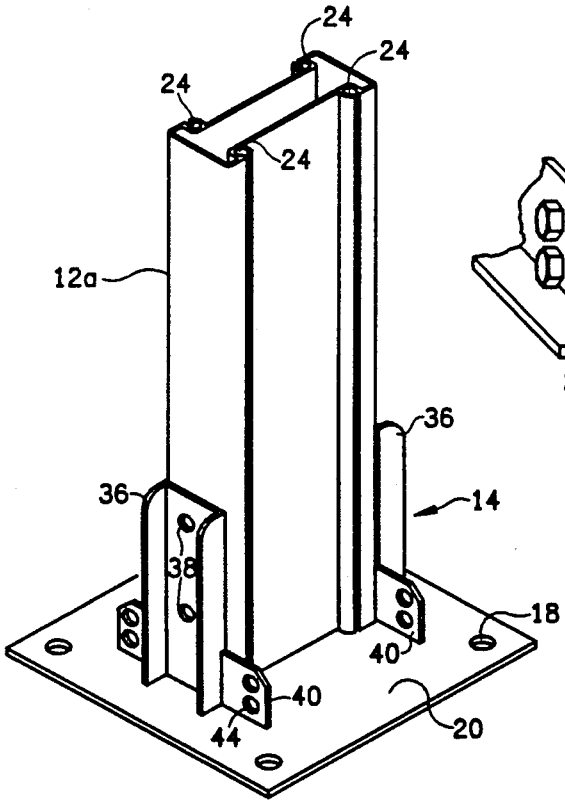
FIG. 2
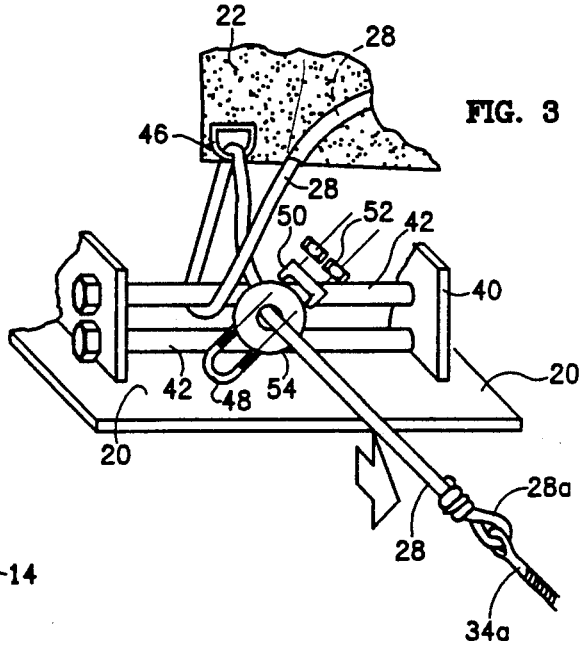
FIG. 3

FABRIC STRUCTURE WITH DOUBLE TENSIONING CABLES

BACKGROUND OF THE INVENTION

The present invention relates to building structures, and more particularly, to building structures of the type in which fabric or other web material is stretched over a metal frame to provide an interior sheltered from the outside environment.

Fabric covered structures in one form or another have been around for thousands of years. Ancient fabric structures took many forms, from very primitive teepees to Arabic palaces. Today, most individuals are familiar with circus tents and tents used for camping.

The need for relatively inexpensive, portable rapidly erected building structures has led to the development of fabric covered frame structures able to handle forty pounds of snow per square foot, winds up to one hundred and twenty miles per hour, and having insulation, heating and cooling comparable to permanent building structures of wood, masonry, concrete or steel.

Building structures have heretofore been developed which have included a plurality of transverse metal arches with individual fabric panels stretched therebetween. The fabric panels have been stretched by separating the arches and/or pulling transversely on the ends of the panels In my U.S. Pat. No. 4,644,706 granted Feb. 24, 1987 I disclose an efficient mechanism for accomplishing transverse stretching of fabric panels. Each fabric panel has arcuate end edges providing doors to the interior of the structure. A single arcuate cable is attached to each end edge of each panel. The ends of these cables are fed around rollers on base mechanisms attached to the lower ends of the arches and drawn together to tension the panels. It would be desirable to eliminate the arcuate end edges of the panels so that the interior of the structure is completely enclosed for heating or cooling. Therefore, a mechanism must be provided for stretching and tightening all portions of such fabric panels, including the rectangular end portions thereof which are nearest to the ground.

SUMMARY OF THE INVENTION

It is therefore the primary object of the present invention to provide an improved fabric covered frame structure.

It is another object of the present invention to provide such a structure having a plurality of transversely extending arches, a plurality of fabric panels connected between adjacent pairs of the arches, and improved means for transversely stretching the fabric panels.

Another object of the present invention is to provide such a structure which may be rapidly assembled with a minimum amount of connectors and other hardware.

Another object of the present invention is to provide such a structure which has inner and outer fabric skins to provide better thermal insulation.

Another object of the present invention is to provide such a structure which has a durable construction.

Another object of the present invention is to provide such a structure which is aesthetically appealing due to the fact that the fabric panels are tensioned transversely to make them curved, depressed, and wrinkle-free between the arches.

In accordance with my invention a rapidly erectable building structure includes a plurality of arches each having a pair of lower ends Base mechanisms are provided for holding the lower ends of the arches to position them in longitudinally spaced, transversely extending, vertical positions. A plurality of panels of a flexible web material are stretched between the arches. Each panel has a pair of opposite side edges, a width corresponding to a longitudinal distance between adjacent ones of the arches and a length corresponding to a transverse distance spanned by the arches. A first pair of lines is connected to a first end portion of each panel and a second pair of lines is connected to an opposite second end portion of the same panel. The lines extend generally arcuately between the side edges of the panel and are spaced a predetermined distance apart in the transverse direction. The base mechanisms guide the terminal segments of each line so that they can be pulled together to thereby transversely tension the panels between the arches.

BRIEF DESCRIPTION OF THE DRAWINGS

FIG. 1 is a side elevation view illustrating a portion of a building constructed in accordance with a preferred embodiment of my invention.

FIG. 2 is an enlarged perspective view of one of the base mechanisms utilized with the preferred embodiment showing the section of an arch mounted thereto.

FIG. 3 is an enlarged fragmentary perspective view illustrating the manner in which cables connected to the end portions of the fabric panels of the preferred embodiment are tensioned using the base mechanisms.

DESCRIPTION OF THE PREFERRED EMBODIMENT

The entire disclosure of my U.S. Pat. No. 4,644,706 granted Feb. 24, 1987 and entitled BUILDING STRUCTURE WITH TRANSVERSELY TENSIONED FABRIC COVERING is specifically incorporated herein by reference.

FIG. 1 illustrates a portion of a building structure 10 including a plurality of arches 12 each having a pair of lower ends. Means in the form of base mechanisms 14 are provided for holding the lower ends of the arches to position them in longitudinally spaced, transversely extending, vertical positions. The base mechanisms may be secured to the ground 16 by hammering pins (not illustrated) through holes 18 (FIG. 2) in their horizontal metal base plates 20.

Referring again to FIG. 1, the building structure 10 further includes a plurality of rectangular panels 22 of a flexible web material connected between adjacent ones of the arches 12. Each panel has a pair of opposite side edges (left and right in FIG. 1), a width corresponding to a longitudinal distance between adjacent ones of the arches 12, and a length corresponding to a transverse distance spanned by the arches. The panels 22 are stippled in FIG. 1 and extend all the way to the ground 16 so that the interior of the building structure is completely enclosed. One suitable high strength, durable web material is coated or laminate polyester vinyl chloride (PVC) fabric. By way of example the laminate PVC may be rated at eighteen ounces per square foot and the coated PVC may be rated at twenty-two pounds per square foot. The web material may also comprise various other coated and uncoated woven fabrics.

Referring to FIG. 2, each arch 12 comprises a plurality of hollow extruded Aluminum box beam segments 12*a* joined end to end via internally inserted Aluminum or other metal moment splices (not illustrated). The shapes of the box beam segments, i.e. straight, slightly curved, etc. are selected to achieve both the span, pitch and profile of the building suited to the particular usage, snow load, and other design parameters. Each box beam segment, such as 12*a*, is formed with pairs of outwardly opening rounded slots 24 on opposite sides thereof. The side edges of the web panels 22 have extruded PVC ropes (not illustrated) stitched, dielectric welded or otherwise connected thereto as disclosed in my U.S. Pat. No. 4,593,710 granted Jun. 10, 1986 and entitled FRAMED TENSION STRUCTURE. These ropes have a length and a diameter such that they may be snugly threaded through corresponding ones of the slots 24. The twin slots on opposite sides of the beam segment 12*a* permit upper and lower spaced apart web panels (not illustrated) to be attached between adjacent arches. This provides a space between the panels which may be filled with R19 fiberglass insulation bats or other suitable insulation.

Reffering again to FIG. 1, the arches 12 are rigidly connected by horizontally extending purlins 26. The purlins are also made of extruded Aluminum and their opposite ends are bolted to the arches.

Each of the web panels 22 has a first pair of lines 28 and 30 (FIG. 1) connected to a first end portion of the panel and a second pair of lines (not visible in FIG. 1) connected to an opposite second end portion of the panel. The lines extend generally arcuately between the side edges of the panel and are spaced a predetermined distance apart in the transverse direction (up and down in FIG. 1). By way of example, each line may comprise a three-sixteenths inch stranded stainless steel cable. The cable may be dielectric welded to a PVC fabric panel along the entire segment thereof that overlies the width of the panel. As best seen in FIG. 3, the lines 28 and 30 of each panel have terminal segments that extend beyond the lower end edges of the panel. These terminal segments of the lines 28 and 30 are guided around an adjacent pair of the base mechanisms 14 and pulled together to tension the panel. This pulling together is illustrated by the arrows in FIG. 1. It may be accomplished by a person 32 operating a manual winch 34 connected the opposite ends of the same line. Depending upon the way they are attached, the lines 28 and 30 may each assume the shape of a catenary.

Referring to FIG. 2, each base mechanism 14 includes the horizontal base plate 20 and means for rigidly connecting a corresponding lower end of one of the arches to the base plate. This means may take the form of a pair of vertical metal brackets 36 welded to the plate which are positioned for receiving the lower end of beam segment 12*a* therebetween. The brackets have holes 38 for receiving bolts (not illustrated) that may be tightened into threaded holes in the beam segment 12*a*. Pairs of ears 40 are welded to each bracket 36 and extend outwardly therefrom. Pairs of rollers 42 (FIG. 3) extend through holes 44 (FIG. 2) in the ears 40. The rollers may take the form of long bolts. A first pair of the rollers is thus provided on a first side of the base plate 20 and a second pair of the rollers is provided on a second side of the base plate 20 for rotation about respective horizontal axes.

Referring to FIG. 3, the terminal segment of each line such as 28 is first threaded around one of the rollers 42 and then through a ring 46 connected to the lower end of the web panel 22. The terminal segment is then threaded back around the same roller 42 and connected to the winch before tightening. The end of the terminal segment may be provided with a permanent loop 28*a* to facilitate rapid connection to a quick release hook 34*a* of the winch. Once the terminal segments of the same line are connected to the winch it may be jacked to pull the ends of the line together. This pulls the ropes connected to each of the side edges of the panel downwardly through the slots 24 in the arches. By pulling the ends of the line 28 together until adequate tension has been achieved, wrinkles in the portions of the panel above the line 28 may be removed. Then a threaded U-shaped shackle 48 may be inserted around the line adjacent the roller 42 and through a clamp 50. Bolts 52 may be tightened to prevent the release of tension when the winch is removed. If desired, the terminal segments of the line 28 may be threaded through a washer 54 before tightening.

I have found that a single arcuate line 28 having a substantial radius of curvature on each end portion of a panel is adequate to tighten the portion of the panel extending over the top of the structure to the other line. However, the end portions of the panel, i.e. those portions extending from the line 28 to the ground 16 are not adequately tightened with such an arrangement. Accordingly, my invention makes use of a secondary tensioning line 30. Furthermore, I have discovered that the spacing and curvature of the lines needs to be optimized if complete tightening of the web panel is to be readily achieved. The apex Al (FIG. 1) of the first line 28 of each pair of lines is preferably spaced a distance D1 from the corresponding end edge of the panel which is equal to approximately 50% of the width W of the panel. The apex A2 of the second line 30 of the pair is spaced from the end edge of the panel a distance D2 equal to approximately 2%–10% of the width W of the panel. More preferably, the distance D2 is equal to approximately 2%–6% of the distance W.

A building constructed in accordance with my invention may have many more arches than the number depicted in FIG. 1. The ends of the building may be enclosed in a fashion illustrated in either of my two prior patents listed above, or in some other fashion. Openable doors may be provided in any of the web panels. My invention allows a large enclosed structure to be rapidly erected and disassembled and is particularly well suited for fairs and conventions. The cost per square foot is a fraction of that for permanent structures.

While I have described a preferred embodiment of my fabric covered building structure with double tensioning cables, it should be understood that modifications and adaptations thereof will occur to persons skilled in the art. Therefore, the protection afforded my invention should only be limited in accordance with the scope of the following claims.

I claim:

1. A building structure, comprising:

a plurality of arches each having a pair of lower ends;

base means for holding the lower ends of the arches to position them in longitudinally spaced, transversely extending, vertical positions;

a plurality of panels of a flexible web material each having a pair of opposite side edges, a width corresponding to a longitudinal distance between adjacent ones of the arches and a length corresponding to a transverse distance spanned by the arches;

each panel having a first pair of lines connected to a first end portion of the panel and a second pair of lines connected to an opposite second end portion of the panel, the lines having terminal segments and extending generally arcuately between the side edges of the panel and being spaced a predetermined distance apart in the transverse direction;

means for connecting the side edges of each of the panels to corresponding ones of the arches; and the base means each including means for guiding the corresponding terminal segment of each line so that the terminal segments of the same line can be pulled together to thereby transversely tension the panels.

2. A building structure according to claim 1 wherein each of the arches has a pair of outwardly opening slots formed in a pair of opposite sides of the arch and the means for connecting the side edges of the panels to the arches includes ropes attached to the side edges of the panels and threaded through corresponding ones of the slots.

3. A building structure according to claim 1 wherein a pair of panels is connected between each adjacent pair of arches, one directly over and vertically spaced from the other.

4. A building structure according to claim 1 wherein each base means includes a horizontal base plate, means for rigidly connecting a corresponding lower end of one of the arches to the base plate, and the means for guiding includes a first pair of the rollers rotatably mounted on a first side of the base plate and a second pair of the rollers rotatably mounted on a second side of the base plate, the rollers being capable of rotation about respective horizontal axes.

5. A building structure according to claim 1 wherein an apex of a first line of each pair is spaced a distance from a corresponding end edge of the panel which is equal to approximately 50% of the width of the panel.

6. A building structure according to claim 5 wherein an apex of a second line of the pair is spaced from the end edge of the panel a distance equal to approximately 2%–10% of the width of the panel.

7. A building structure according to claim 5 wherein an apex of a second line of the pair is spaced from the end edge of the panel a distance equal to approximately 2%–6% of the width of the panel.

* * * * *